US008696157B2

(12) United States Patent
McClellan

(10) Patent No.: US 8,696,157 B2
(45) Date of Patent: Apr. 15, 2014

(54) HEAT SINK AND LED COOLING SYSTEM

(75) Inventor: Thomas David McClellan, Santa Cruz, CA (US)

(73) Assignee: Cool Lumens, Santa Cruz, CA (US)

( * ) Notice: Subject to any disclaimer, the term of this patent is extended or adjusted under 35 U.S.C. 154(b) by 387 days.

(21) Appl. No.: 12/902,041

(22) Filed: Oct. 11, 2010

(65) Prior Publication Data

US 2012/0085516 A1 Apr. 12, 2012

(51) Int. Cl.
*F21V 21/00* (2006.01)

(52) U.S. Cl.
USPC ..... 362/249.02; 362/373

(58) Field of Classification Search
USPC ..... 362/249, 249.02, 373
See application file for complete search history.

(56) References Cited

U.S. PATENT DOCUMENTS

| | | | | |
|---|---|---|---|---|
| 5,528,471 | A | 6/1996 | Green | |
| 8,138,690 | B2 | 3/2012 | Chemel | |
| 2007/0223248 | A1 | 9/2007 | Han | |
| 2008/0285272 | A1 | 11/2008 | Simon | |
| 2009/0071637 | A1 | 3/2009 | Liao | |
| 2009/0085497 | A1 | 4/2009 | Osborn | |
| 2009/0129102 | A1* | 5/2009 | Xiao et al. | 362/373 |
| 2009/0267540 | A1 | 10/2009 | Chemel | |
| 2010/0091495 | A1* | 4/2010 | Patrick | 362/249.02 |
| 2010/0124058 | A1* | 5/2010 | Miller | 362/249.02 |
| 2010/0126697 | A1 | 5/2010 | Huang | |
| 2010/0181889 | A1 | 7/2010 | Falicoff | |

* cited by examiner

*Primary Examiner* — Mary Ellen Bowman
(74) *Attorney, Agent, or Firm* — Larry Guernsey; Patent Law Office of Larry Guernsey

(57) ABSTRACT

A heat sink for cooling LEDs, which includes a heat sink housing which is configured as a finned concentric tube configuration. Also, an LED heat sink assembly and an LED cooling system which include a heat sink housing which is configured as a finned concentric tube configuration. Also, a method for cooling LED modules.

24 Claims, 12 Drawing Sheets

HEAT SINK AND LED COOLING SYSTEM

TECHNICAL FIELD

The present invention relates generally to illumination sources and more particularly to heat sink devices for LED illumination sources.

BACKGROUND ART

An Light-Emitting Diode (LED) is a semiconductor light source, which have many practical applications due to their longer lifetime, faster switching, smaller physical size, greater durability and higher energy efficiency.

When a light-emitting diode is forward biased, electrons (negative charges) recombine with holes (positive charges), which releases energy in the form of photons. The energy difference within the diode produces photons of different wavelengths, for different colors, which do not require color filters to produce. LEDs are solid state devices and if operated at low currents and at low temperatures, are subject to very limited wear and tear. Typical lifetimes are estimated to be 35,000 to 50,000 hours of useful life, compared to 10,000 to 15,000 hours for fluorescent tubes, and 1,000-2,000 hours for incandescent light bulbs. LEDs are also less fragile than fluorescent and incandescent bulbs, and are less susceptible to damage by external vibration.

LEDs produce more light per watt than incandescent bulbs, and are ideal for use in applications that are subject to frequent on-off cycling, unlike fluorescent lamps that burn out more quickly when cycled frequently. LEDs can very easily be dimmed continuously unlike fluorescent lamps which require a certain threshold voltage to maintain illumination.

LEDs have been found to have significant environmental benefits compared to other alternatives. It has been estimated that a building's carbon footprint from lighting can be reduced by 68% by exchanging all incandescent bulbs for new LEDs. LEDs are also non-toxic compared to compact fluorescent, which contains traces of mercury. Organic light emitting diodes (OLEDs) can be produced that use an organic compound as the emitting layer material of the LED, which can be a polymer.

Performance of LEDs is temperature dependent, and LED light output actually increases at cold temperatures. LEDs do not generate as much heat as incandescent bulbs, by not producing invisible light in the infrared range, but they do produce internal heat which must be dissipated if the LED is to maintain good performance. Over-heating of the LED is a major factor in device failure. Heat sinks are necessary to maintain long life of the LED. This is especially important to have a low failure rate when LEDs are used in automotive, medical, and military applications where the device must operate over a large range of temperatures, and failure could create serious problems.

Heat sinks are currently available for LEDs, but any improvement in cooling can increase device operations and reliability. Some heat sinks are made very simply. They incorporate different numbers of cooling fins. Some have a little and some have many. The thinking for some developers is to add more fins and deeper fins. This does provide some cooling effect for the heat sink, as just using fins of any kind helps somewhat. However, the right balance of parameters is important in providing improved cooling. For example, if the fins are too deep, it works in reverse, and heat is maintained. Therefore, it is important to consider many parameters and their interaction to provide improved heat transfer, and more efficient cooling, and therefore better performance and longer lifespan of the LEDs.

Thus, there is need for an LED heat sink cooling system that has improved cooling properties, and thus produces improved device performance for LEDs.

DISCLOSURE OF INVENTION

Briefly, one preferred embodiment of the present invention is a heat sink for cooling LEDs, which includes a heat sink housing that is configured as a finned concentric tube configuration.

Also disclosed are an LED heat sink assembly, and an LED cooling system which includes a heat sink housing which is configured as a finned concentric tube configuration.

Also disclosed is a method for cooling LED modules.

An advantage of the present invention is it produces better cooling of LEDs and thus improves performance.

Another advantage of the present invention is it extends the working life of LEDs by providing better cooling.

A further advantage of the present invention is it makes LED lighting more dependable, and thus encourages their use for applications such as in medical devices, transportation devices, etc. where reliability is a very important factor.

And another advantage of the present invention is that by encouraging the use of more reliable LEDs, there are environmental benefits such as reducing carbon footprints of lighting devices.

A further advantage of the present invention is that it includes a cooling cavity between the back of the LED module and the interior channels. This dramatically increased the airflow past the back of the LED module. This cooling cavity is used in conjunction with the mounting plate for the angled version and also connects to the additional multiple side vents in the straight version.

A further advantage of the present invention is that it provides a heat sink housing which is configured as a finned concentric tube configuration.

Yet another advantage of the system of the present invention is it includes air channel devices, which also contributes to cooling.

A yet further advantage of the present invention is that embodiments include angled housing systems and straight housing systems for a variety of mounting and positioning options.

An additional advantage of the present invention is that the angled housing system allows multiple focal optics to change the beam spread according to ceiling height. The heat sink device allows many different lens choices such as clear, frosted, linear, prismatic, etc, for all different applications such as commercial, industrial, retail etc.

Another advantage of the present invention is that the straight housing system allows them to work as one individual or two, three, four, five, up to eight units in one fixture depending on the application.

A yet another advantage of the present invention is that the cooling pipe of the straight housing system utilizes an adjustable swivel for area adjustment. This makes the present invention more adaptable to applications with all different ceiling heights.

These and other advantages of the present invention will become clear to those skilled in the art in view of the description of the best presently known modes of carrying out the invention and the industrial applicability of the preferred embodiment as described herein and as illustrated in the several figures of the drawings.

BRIEF DESCRIPTION OF THE DRAWINGS

The purposes and advantages of the present invention will be apparent from the following detailed description in conjunction with the appended drawings in which.

DETAILED DESCRIPTION OF THE PREFERRED EMBODIMENTS

The present invention is a heat sink LED cooling system, which will be referred to by the reference number 10, and thus shall be referred to as LED cooling system 10. A first preferred embodiment of the LED cooling system 10 and its elements are illustrated in FIGS. 1-10.

Figure 1:
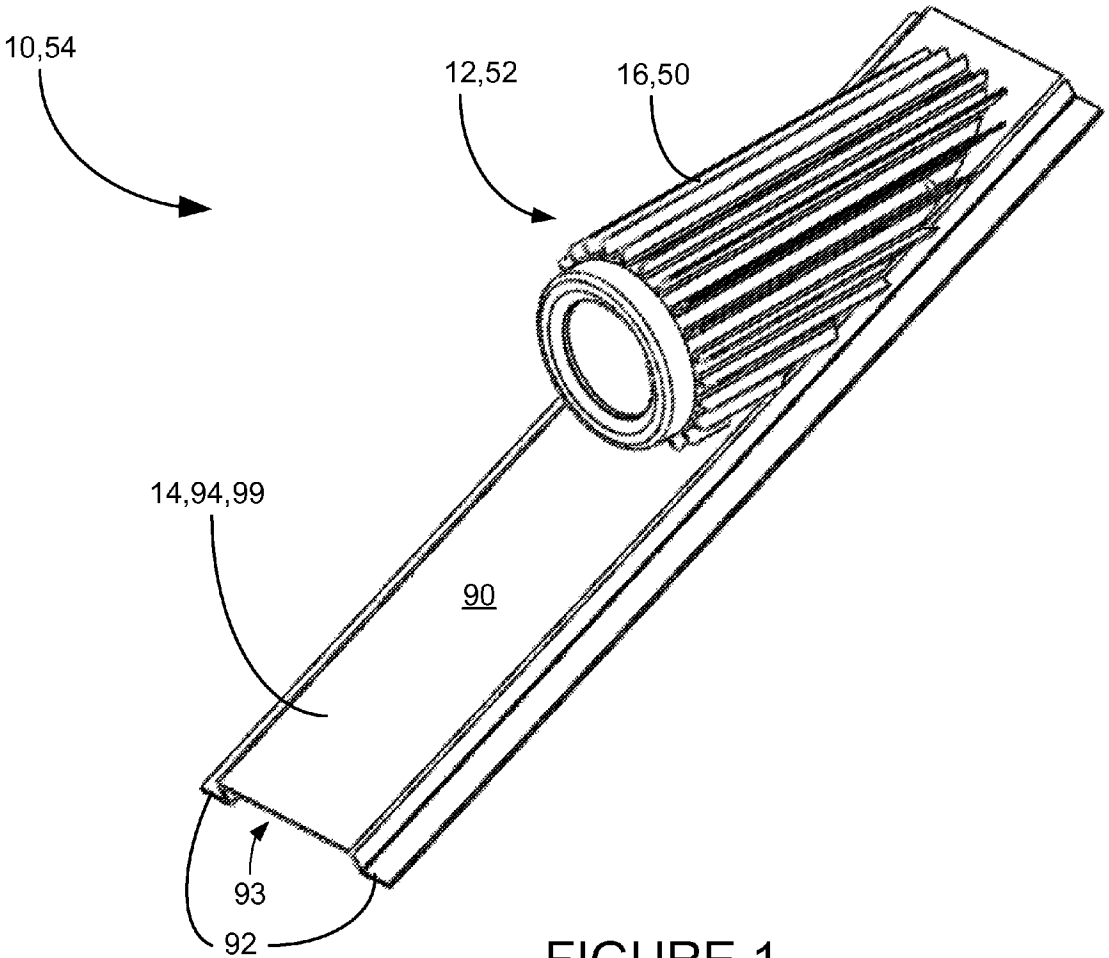
FIG. 1 shows an isometric view of a first embodiment of the LED cooling system of the present invention.

FIG. 1 shows an isometric view of an assembled LED cooling system 10, which includes an LED heat sink assembly 12, and a frame 14, which in itself contributes to the heat transfer effectiveness, as will be discussed below.

Figure 2:
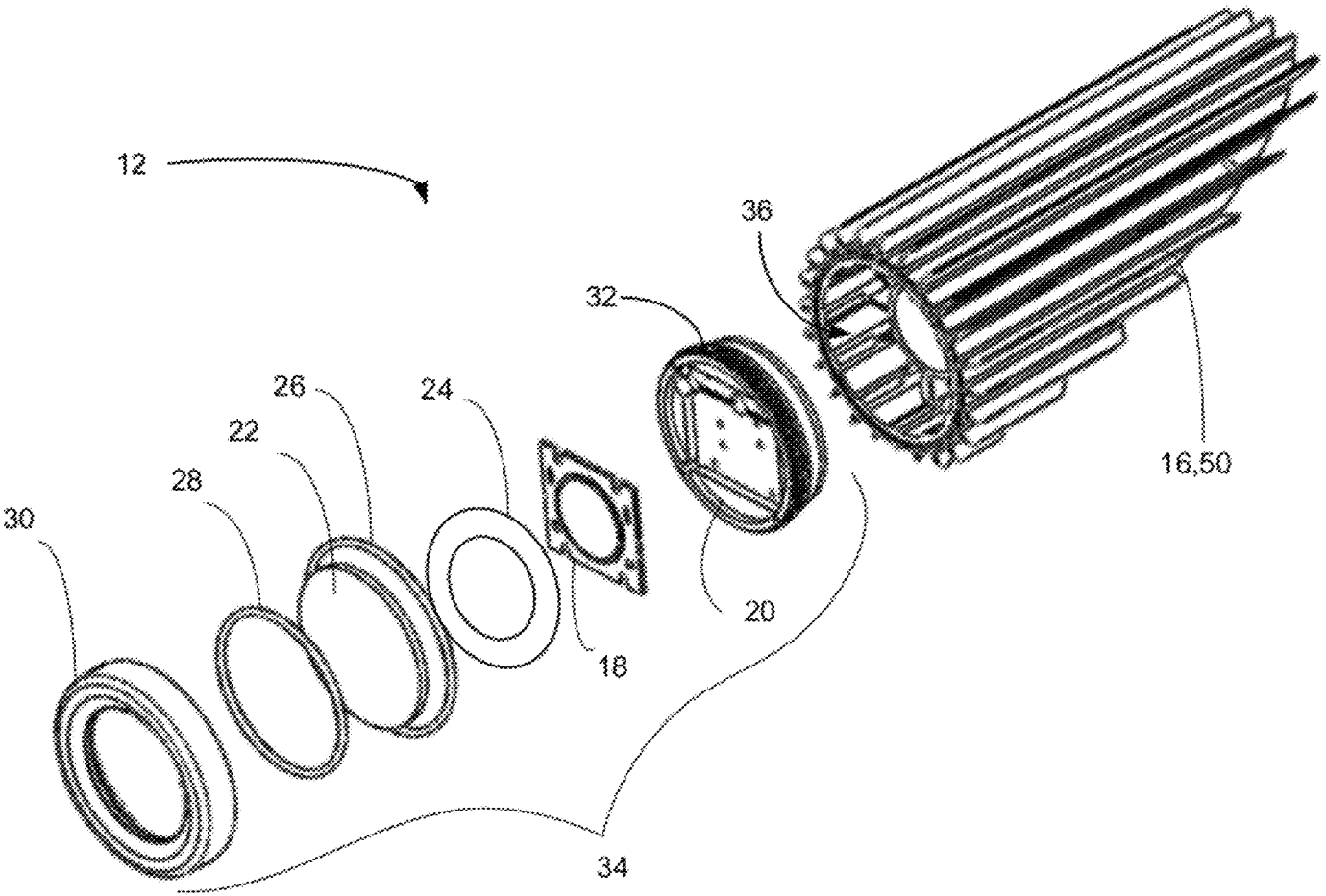
FIG. 2 shows an exploded isometric view of a first embodiment of the LED heat sink assembly of the present invention.

FIG. 2 shows an isometric exploded view of the LED heat sink assembly 12, which includes a heat sink housing 16, and an LED 18, which fits into an LED housing 20. A lens 22 is sandwiched between a shield 24, a first O-ring 26 and a second O-ring 28. A cap 30 attaches to the LED housing 20 by screw threads 32 (see FIG. 9). The assembly, which includes the LED housing 20, LED 18, lens 22, shield 24 and first and second O-rings 26, 28 shall be referred to as the LED module 34. This LED module 34 is fitted into a recess 36 in the heat sink housing 16. The LED module 34 may be removable, but is preferably permanently mounted in the housing 16 by pressed fitting, to provide better thermal contact and therefore better heat transfer.

Figure 3:
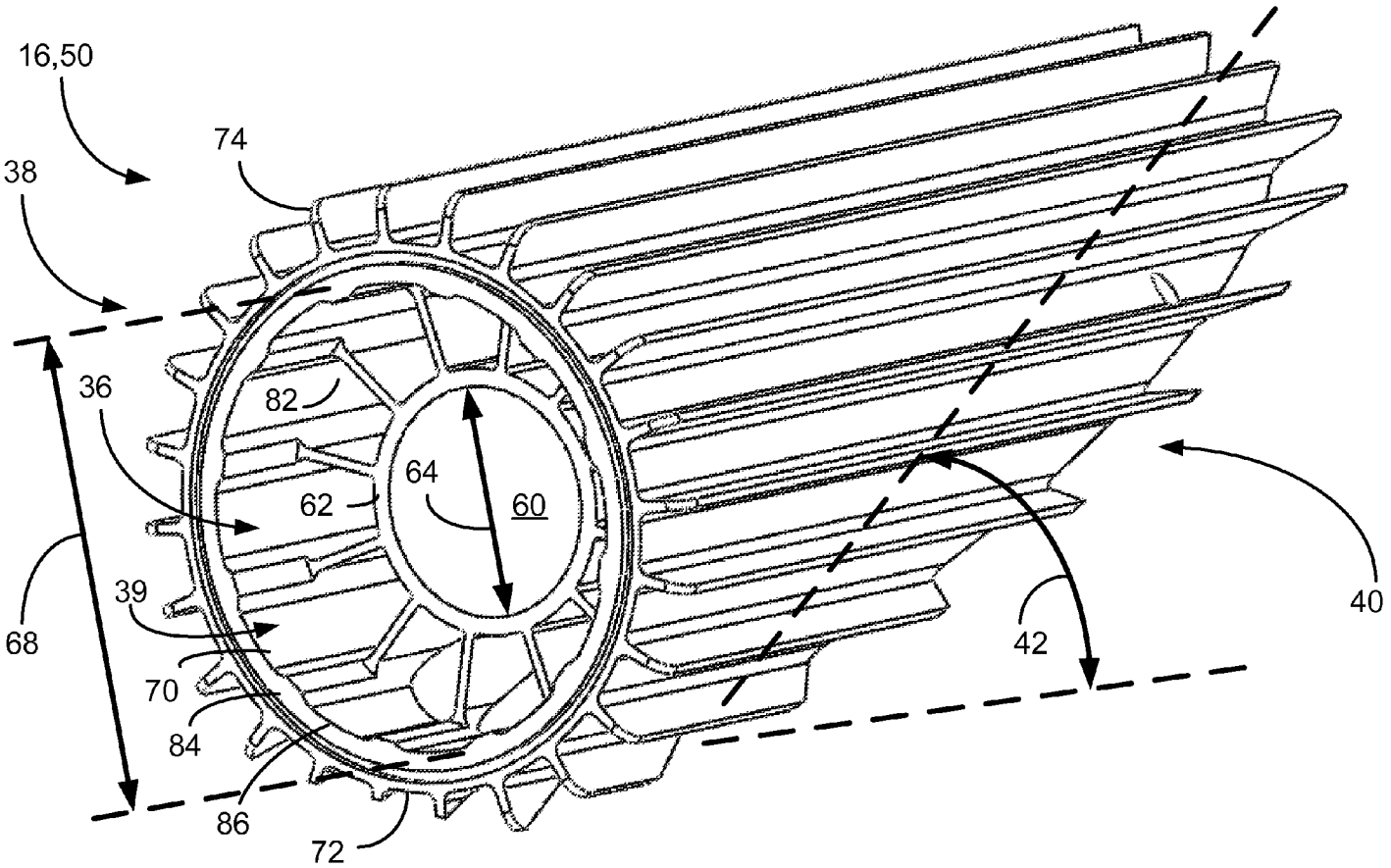
FIGS. 3 and 4 show isometric views of a first embodiment of the heat sink housing of the present invention.
Figure 4:
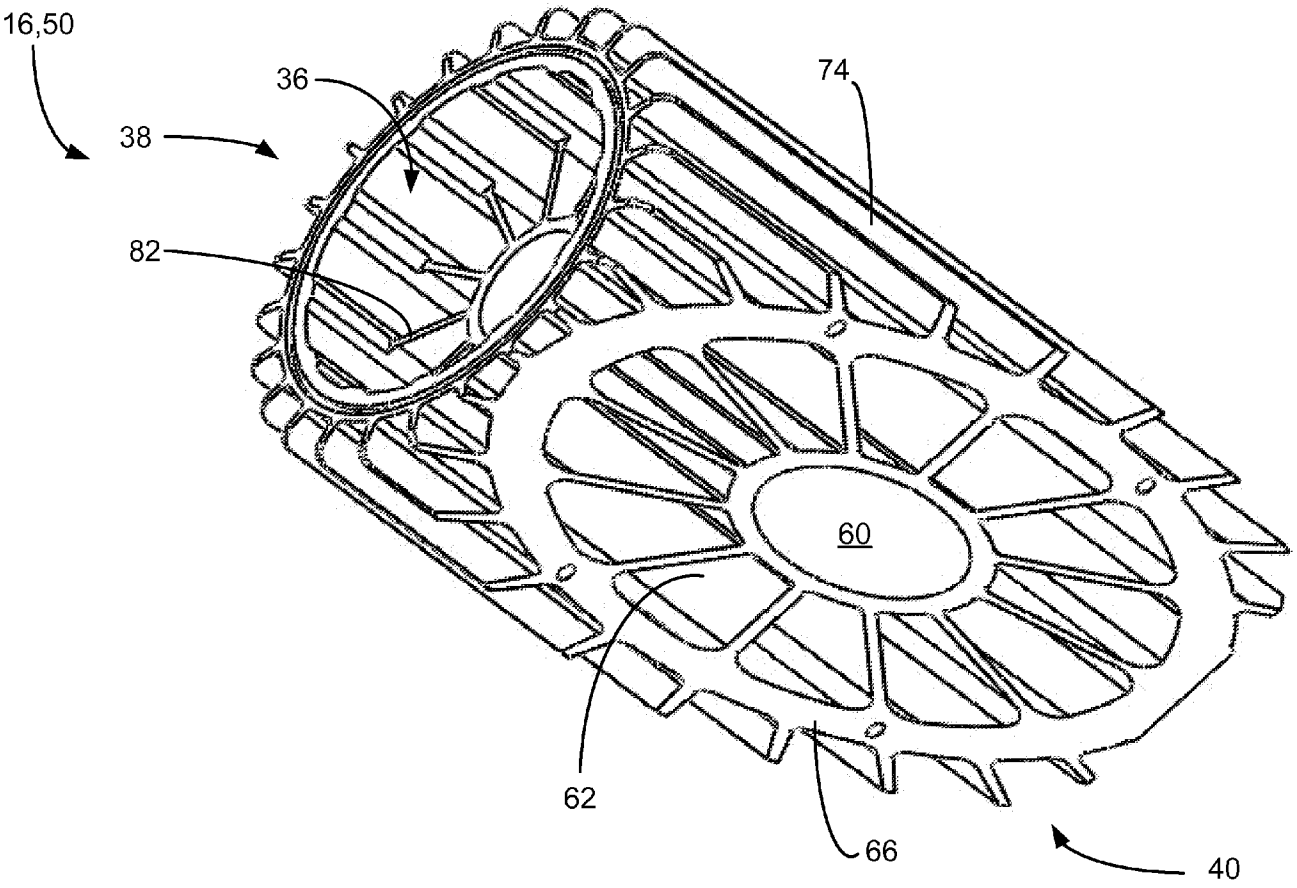

FIGS. 3 and 4 show isometric views of the first embodiment of the heat sink housing 16. The heat sink housing 16 comes in two preferred embodiments, the difference being in the rear portion 40 and the frame 14 or cooling pipe 114 (see FIG. 11) used to mount the housing 16. FIGS. 3-4, as well as FIGS. 1-2, show the first embodiment, wherein the rear portion 40 is angled, preferably at an angle in the range of 5 degrees to 120 degrees, and will therefore be referred to as an angled heat sink housing 50, and the LED heat sink assembly 12 having such an angled heat sink housing 50 as an angled LED heat sink assembly 52. An LED cooling system 10 having an angled LED heat sink assembly 52 will be referred to as an angled LED cooling system 54.

The housing front portion 38 includes a recess 36 which is configured to receive the LED module 34, and cool it.

Figure 5:
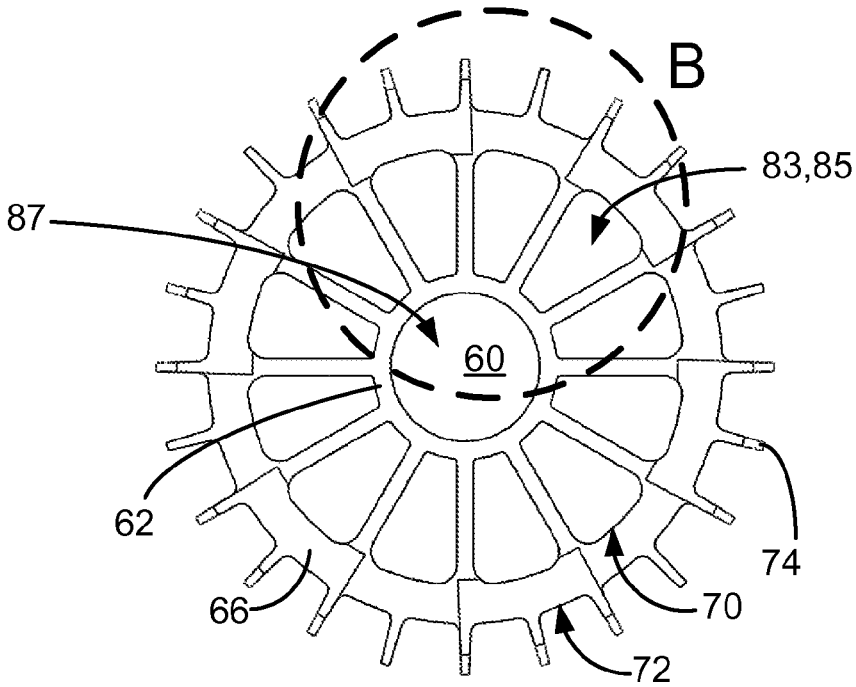
FIG. 5 shows a front elevation view of the heat sink housing of the present invention.
Figure 6:
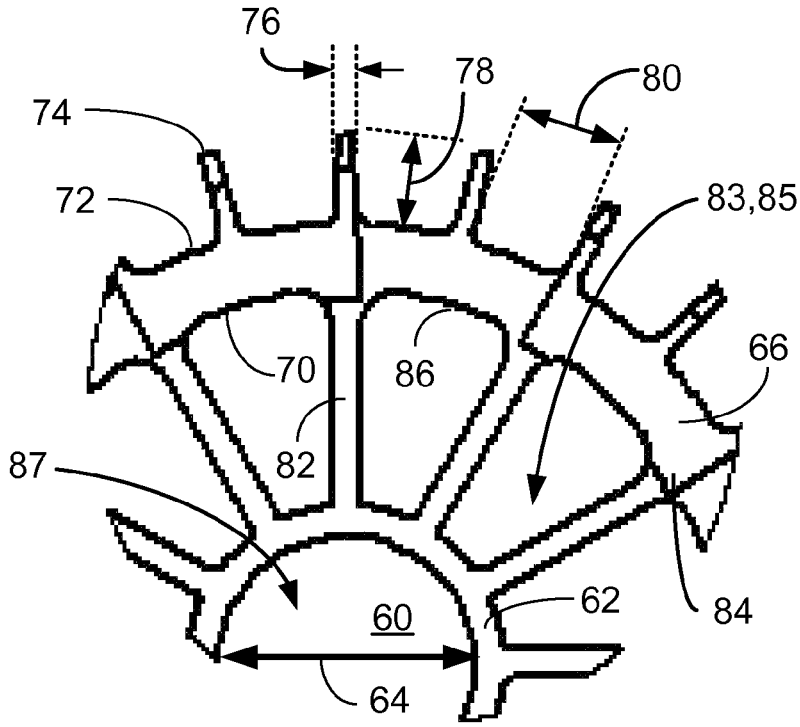
FIG. 6 shows a detail of the front elevation view of the heat sink housing within circle "B" of FIG. 5.

FIG. 5 is a front elevation view of the heat sink housing 16, which can be either an angled heat sink housing 50, or a straight heat sink housing 150, as will be discussed below. FIG. 6 is a detail view of the portion of FIG. 5 enclosed by circle "B" in FIG. 5.

Several parameters are involved in producing superior heat transfer effectiveness in the present invention. The heat sink housing 16 is configured with a central bore 64, which is surrounded by an inner tube 62. A larger outer tube 66 is concentric with the inner tube 62, and the outer tube 66 itself includes an inner surface 70 and an outer surface 72. The outer surface 72 of the outer tube 68 includes a number of external fins 74, which are preferably spaced in a regular fashion around the circumference of the outer tube 68.

In the following discussion, all units are assumed to be inches or fractions of inches. Each of these parameters have been carefully analyzed and designed to be within a specified range in order to provide superior heat transfer. For an LED module 34 with an approximate dimension of 1-3", the outer tube 66 preferably has a diameter 68 of approximately 3.8". The inner diameter of the inner tube 66, and thus also the diameter of the central bore 64, is preferably approximately 3". The number of fins 74 arranged around the outer tube 66 is preferred to be within the range of 18 to 30. The thickness 76 of fins 74 is preferred to be within the range of $^{50}/_{1000}$ to $^{100}/_{1000}$ where the spacing dimension 80 is preferred to be within the range of $^{350}/_{1000}$ to $^{400}/_{1000}$.

A crucial design parameter has been found to be the ratio of the fin spacing 80 to the fin height 78. The preferred range of this ratio of fin spacing 80 to fin height 78 is presently in the range of 0.5:1.0 to 2.0:1.0.

It is to be understood that these figures relate to an LED module 34 having a diameter of approximately 3.8", an inner tube 68 with a central bore diameter 64 of approximately 3" and an outer tube 68 with a diameter 68 of approximately 3.8". It is to be assumed that these parameters would be approximately proportional and would scale roughly for LED modules of different dimension, but this is not to be construed as a limitation.

The present heat sink housing 16 also preferably includes internal fins 82 which join the inner surface 70 of the outer tube 68 at slight rises 84 which are separated by shallow valleys 86. The length of the heat sink housing 16 is also a design parameter. The internal fins 82 separate internal channels 83, which are thus, bounded by the sides of the internal fins 82, the outer surface of the inner tube 62 and the inner surface of the outer tube 66. There are a number of these internal channels 83 thus created between the inner tube 62 and the outer tube 66. The cross-section shown in FIG. 5 shows 12 such internal channels 83, and each internal channel 83 has a cross-sectional area 85. The inner bore 60 also has a cross-sectional area 87, and the ratio of cross-sectional area 87 of the central bore 60 to the cross-sectional area 85 of each of the internal channels 83 has been found to have an important effect of the heat transfer efficiency of the heat sink. The preferred range of this ratio of central bore area 87 to internal channel area 85 is preferably in the range of 0.5:1 to 3:1.

Figure 9:
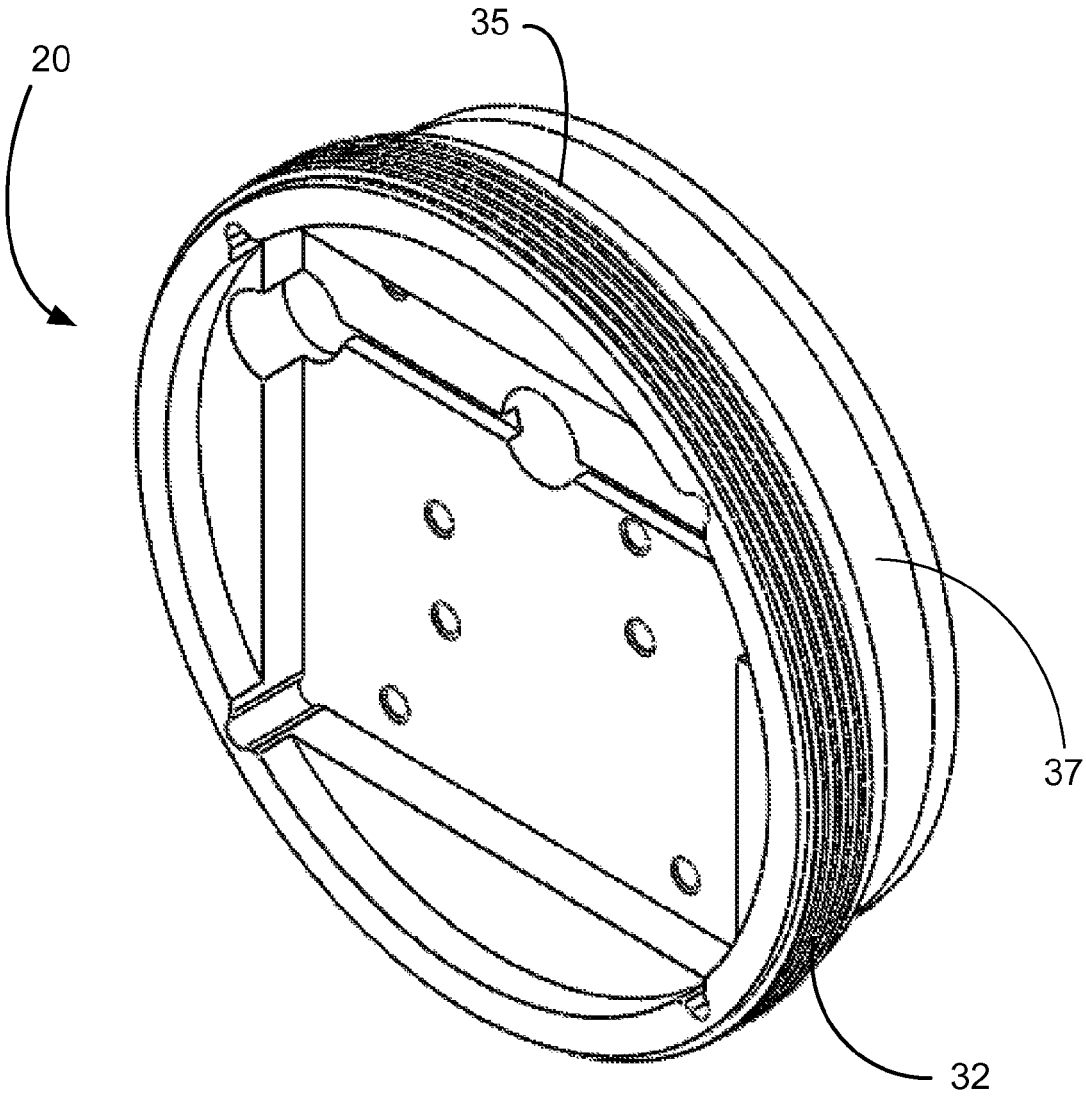
FIG. 9 shows an isometric view of an LED housing.

Additionally, it has been found to be very effective to create a cooling cavity 39 between the LED module 34 and the inner tube 62 of the heat sink housing 50. This is done by creating a rim 35 on the LED housing 20, as shown in FIG. 9. There is a reduced diameter flange 37 at the back end of the LED housing 20, and it is this reduced diameter flange 37 which is inserted into the recess 36 of the heat sink housing 50. The LED housing 20 and the recess 36 of the heat sunk housing 50 are configured so that the travel of the reduced diameter flange 37 into the recess 36 is limited by the contact of the rim 35 against the outer tube 66 of the heat sink housing 50 before the LED housing 20 completely fills the space of the recess 36. This leaves a cooling cavity 85 into which air traveling down the air cooling channel 93 and into the inner tube 66 and internal channels 83 can circulate and more effectively remove heat from the LED 18. This cooling cavity 39 is preferably ¼"-1" in depth between the back of the LED module 34 and the interior channels 83. This dramatically increased the airflow past the back of the LED module.

The configuration of an inner tube 62, an outer tube 66, and internal fins 82 which connect between the inner tube 62 and the outer tube 66, shall be referred to as a finned concentric tube configuration 88. Applicant has found that this finned concentric tube configuration 88 to be especially effective at providing excellent heat transfer from the LED 18, and this is believed to be a novel feature in itself, aside from the adjustment of various other parameters described above.

Figure 7:
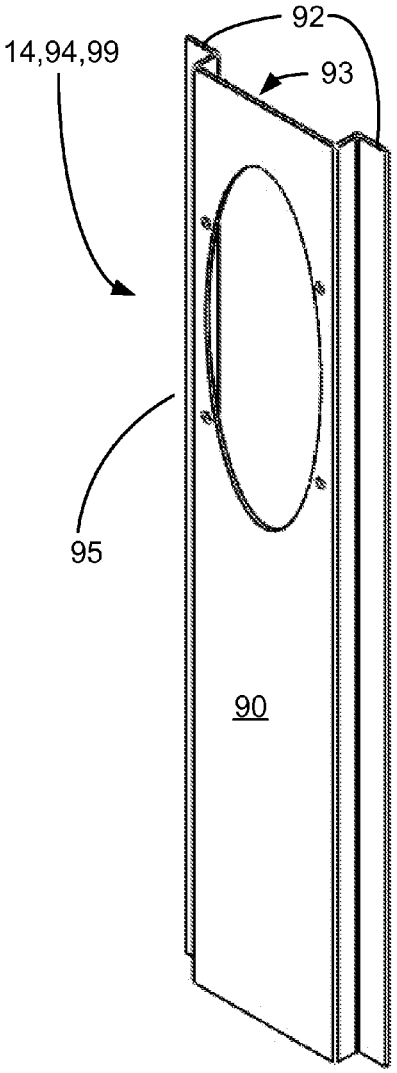
FIGS. 7 and 8 show isometric views of straight and corner frames used with the first embodiment of the heat sink of the present invention.
Figure 8:
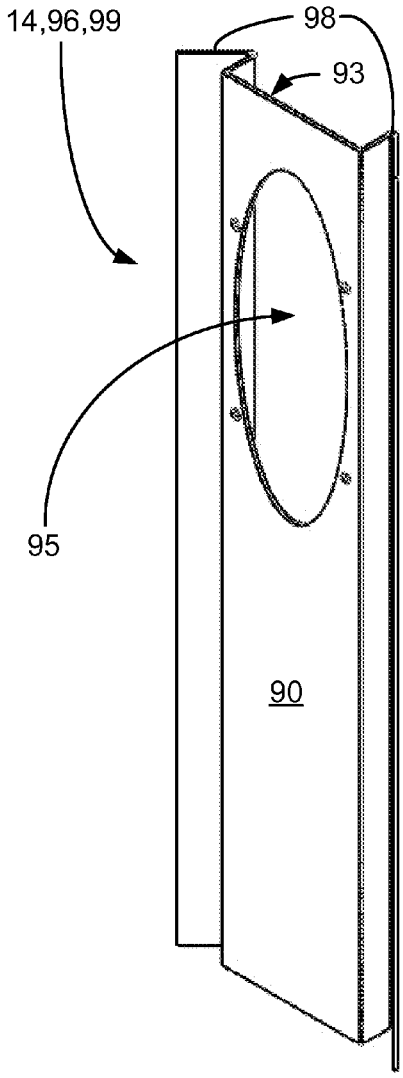

The angled heat sink LED cooling system 54 also preferably includes a frame 14, as discussed above, and shown in FIGS. 1 and 10, as well as in FIGS. 7-8. The frame 14 preferably includes a baseplate 90 and two lips 92. The lips 92 serve to elevate the baseplate 90 from any surface it is mounted on, and create an air channel 93, which allows air flow to pass to and from the heat sink housing 50. Two varieties of frame 14 are shown in FIGS. 7 and 8. The first, shown in FIG. 7 shall be referred to as a planar frame 94, by which it is meant that the planar frame 94 is designed to be mounted on a planar surface such as a wall. The baseplate 90 includes an air-channel cut-out 95, so that an air passage is created which extends down the air channel 93, through the cut-out 95, and extends down the inner tube 62 and the outer tube 66 to reach and cool the LED module 34.

Figure 10:
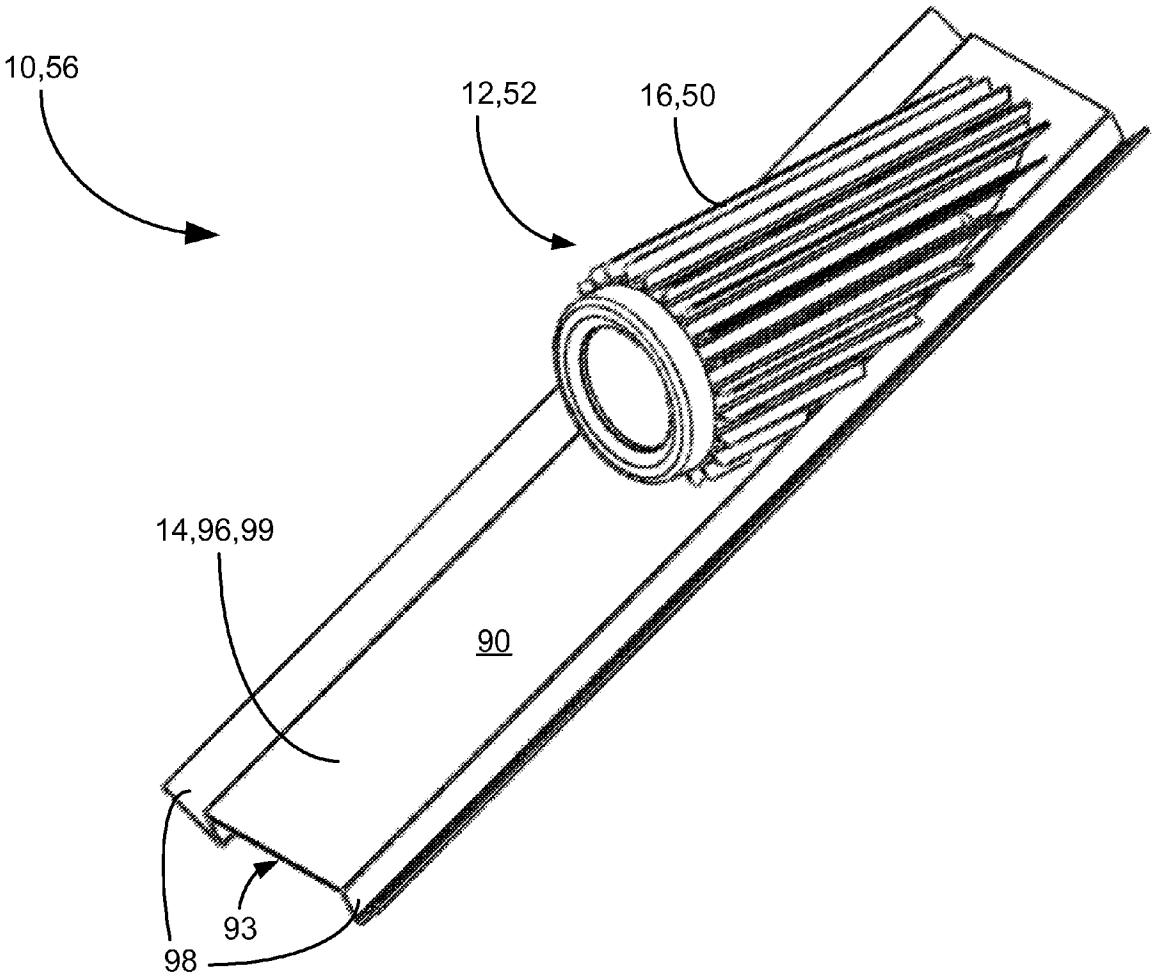
FIG. 10 shows an isometric view of the LED cooling system of the present invention used with corner frames.

A second variety of frame 14 is designed to fit into corners at a 45 degree angle, and is thus referred to as a corner frame 96. It differs from the planar frame 94 by including corner lips 98, which are angled to fit in a corner, as described. It also includes an air channel 93 and cut-out 95 in baseplate 90, as described before. An angled LED cooling system with corner frame 56 is shown in FIG. 10. The frame 14, of either planar 94 or corner 96 configuration, provides an air cooling channel 93, and will be referred to as one type of air cooling channel device 99.

A second preferred embodiment of the LED cooling system 10 and its elements are illustrated in FIGS. 11-14. The second embodiment includes a heat sink housing which is not angled, and thus will be referred to as a straight heat sink housing 150. An assembly which also includes an LED module in a straight heat sink housing 150 will be referred to as a straight LED heat sink assembly 152. Instead of using a frame, this second embodiment preferably includes a cooling pipe 114 to provide an air cooling channel 93 for cooling the LED module 34. When a cooling pipe 114 configured for use with a straight heat sink housing 150 is attached, the resulting system will be referred to as a straight LED cooling system 154. The elements of the LED module 34 are similar to those used in the angled LED cooling system, and where applicable, the same element numbers will be used.

The cooling pipe 114 used in the straight LED cooling system 154, and the frame 14, of both the planar frame 94 and corner frame 96 varieties, provide an air cooling channel 93 and both are types of air cooling channel devices 99.

Figure 11:
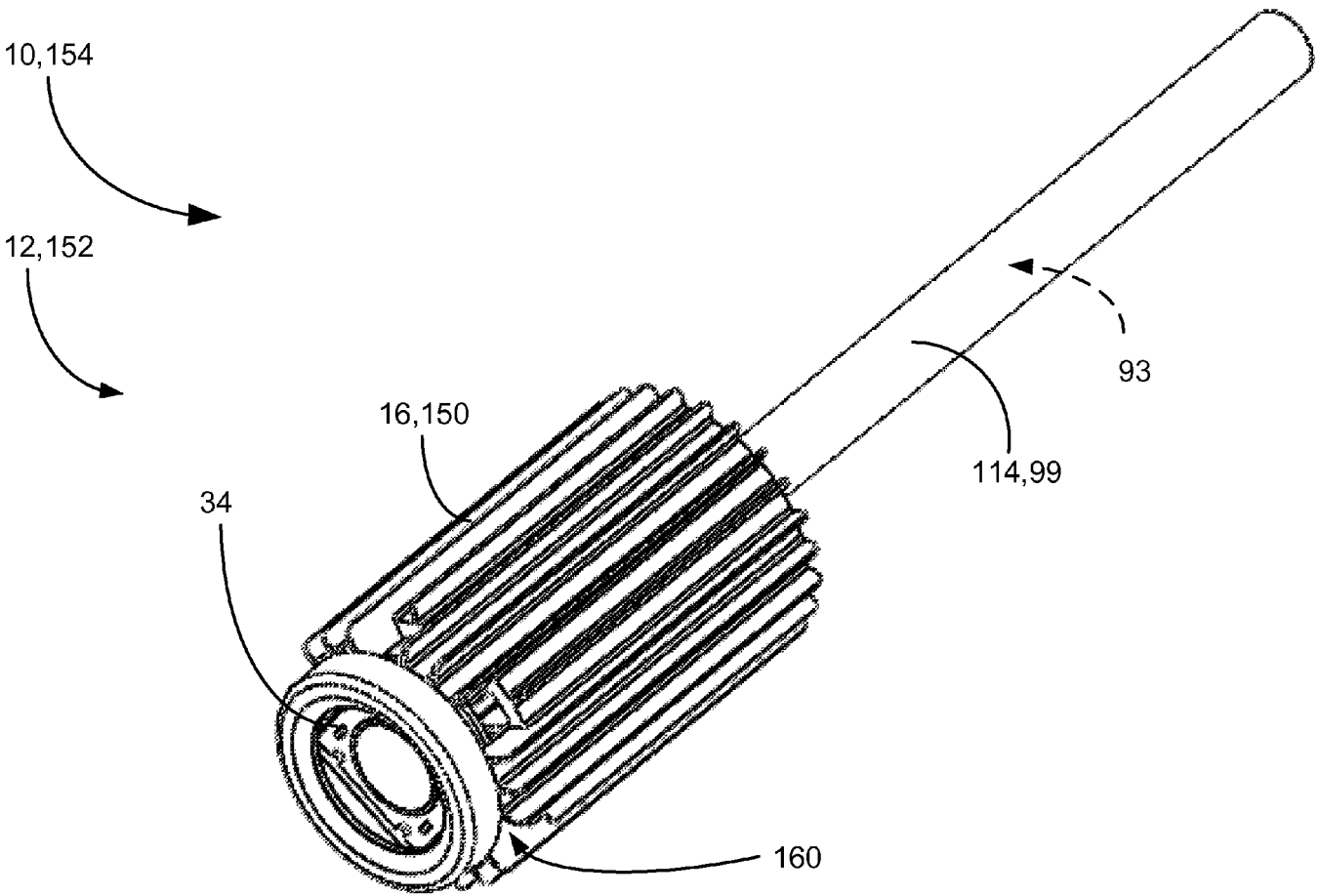
FIG. 11 shows an isometric view of a second embodiment of the LED cooling system of the present invention.

FIG. 11 shows an isometric view of an assembled straight LED cooling system 154, which includes an straight LED heat sink assembly 152 and a pipe 114, which has been configured for use with the straight LED heat sink housing 150.

Figure 12:
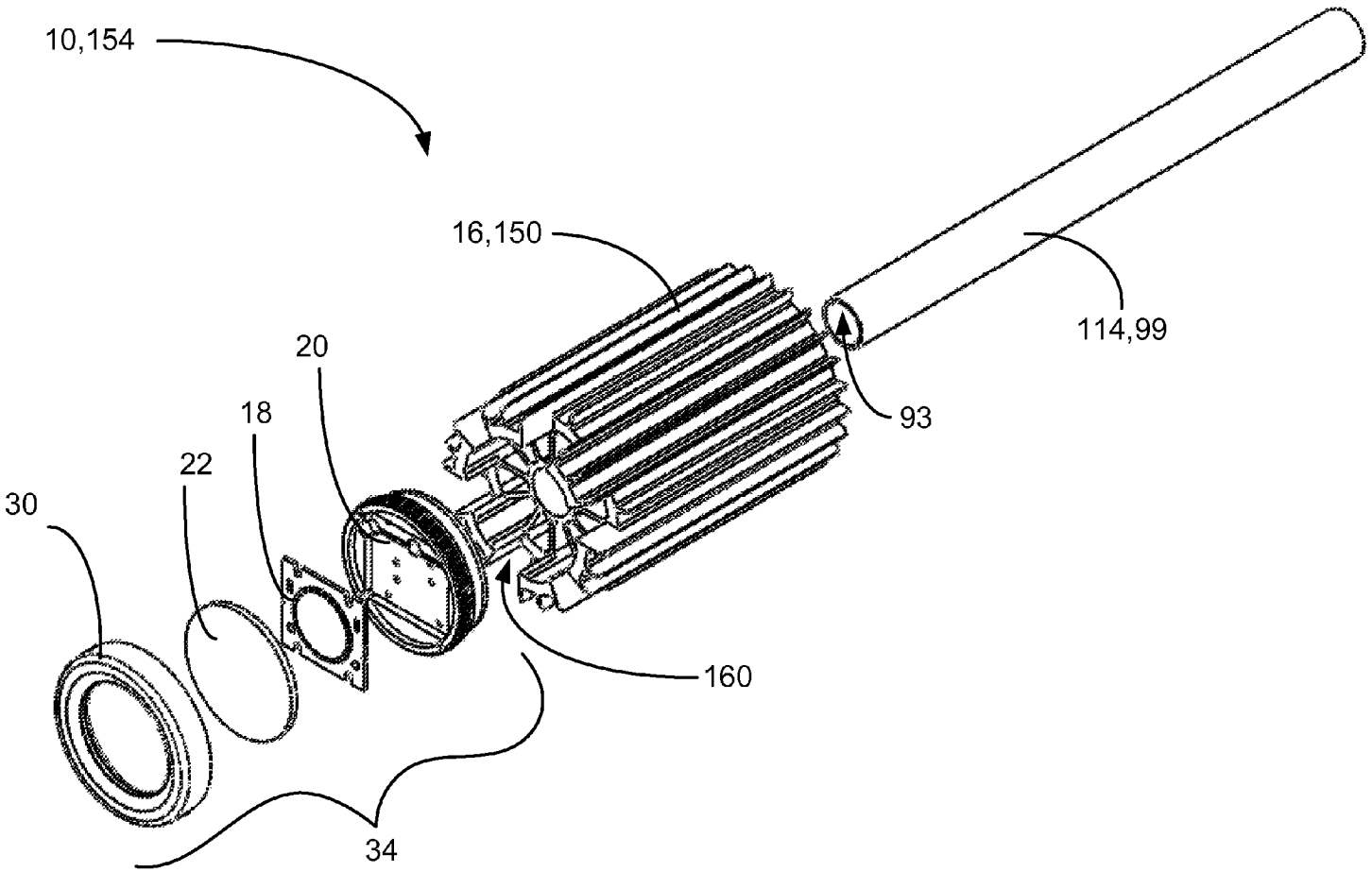
FIG. 12 shows an exploded isometric view of a second embodiment of the LED cooling system of the present invention.
Figure 13:
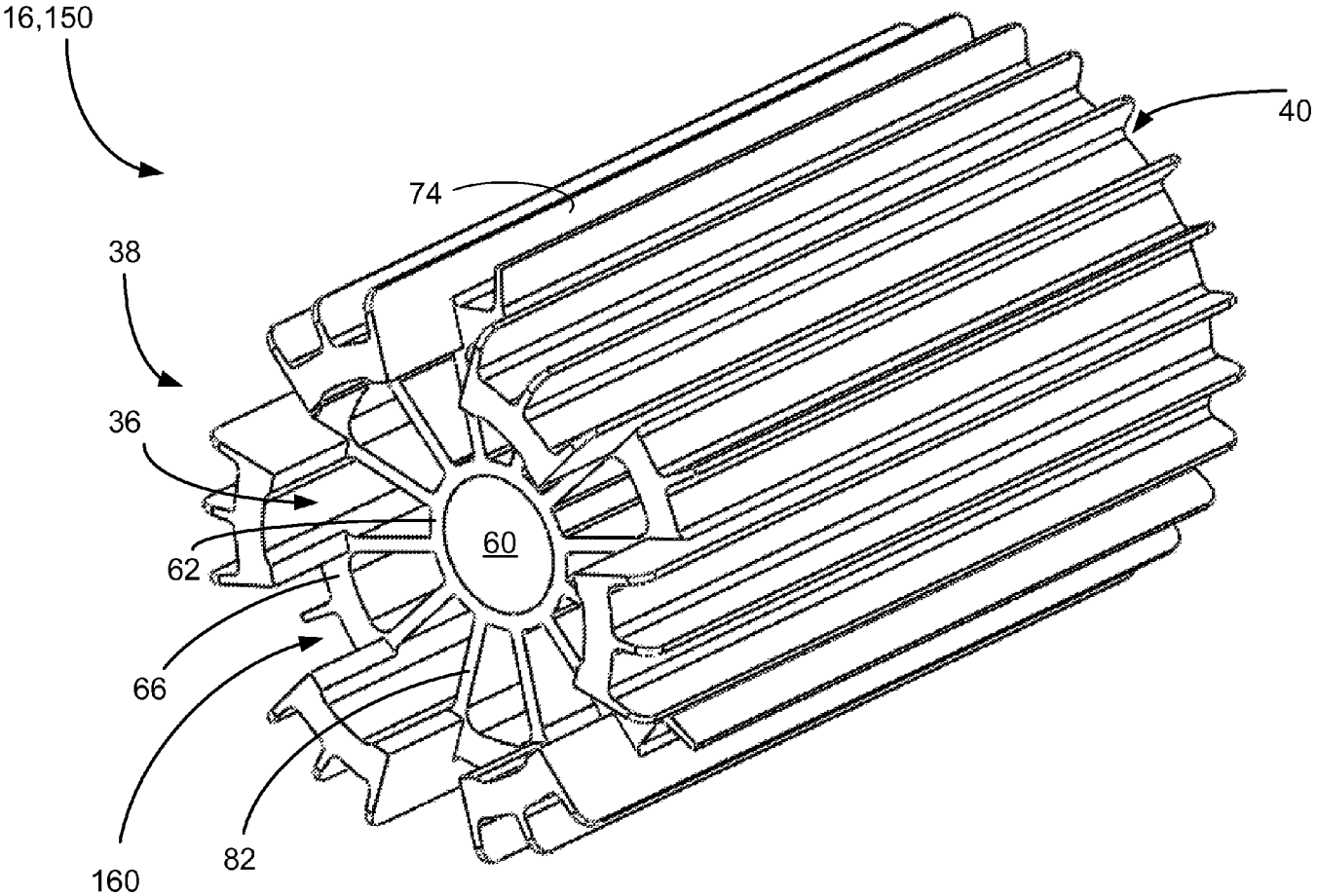
FIGS. 13-14 show isometric views of the straight heat sink housing of the present invention.
Figure 14:
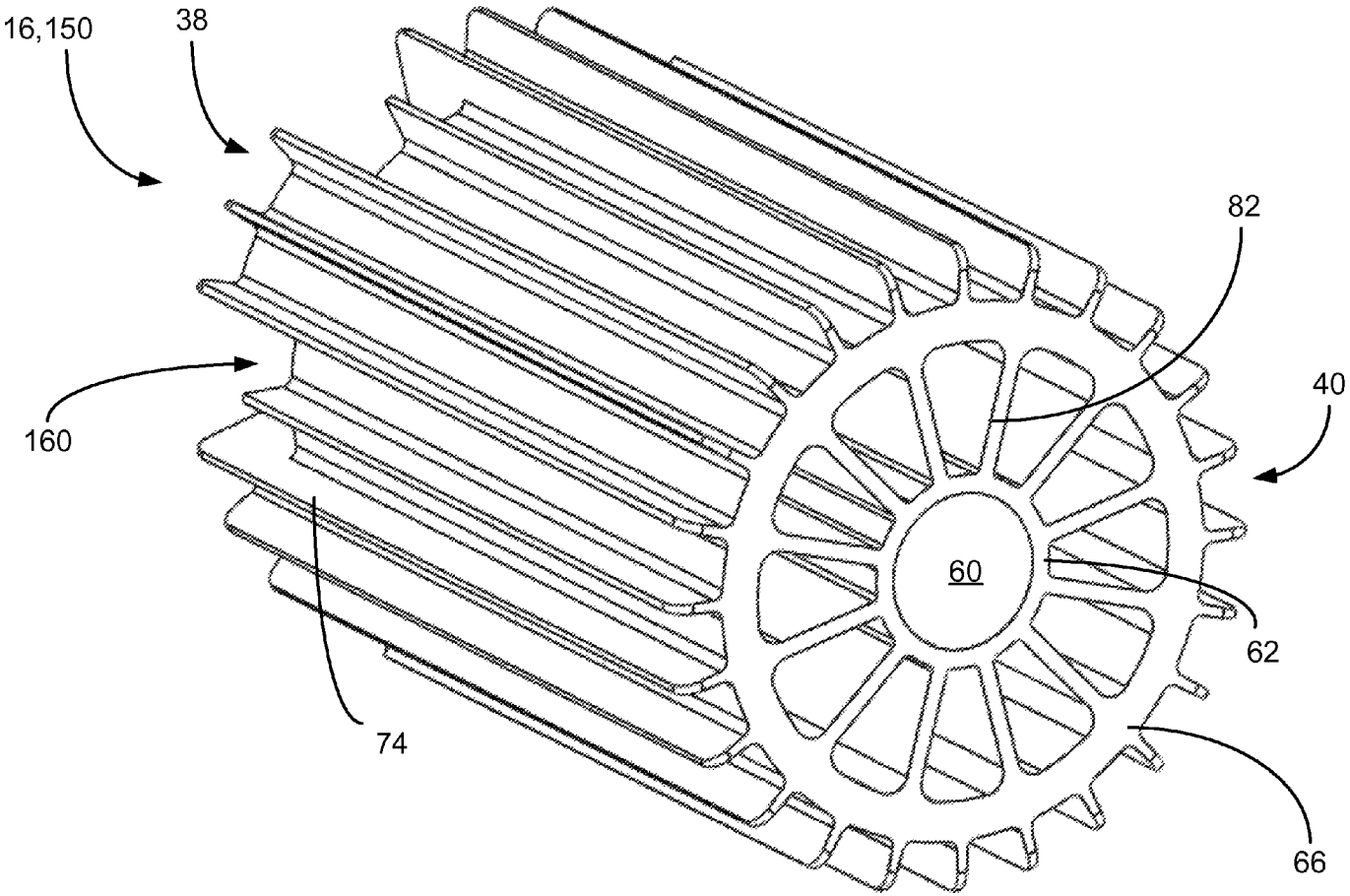

FIG. 12 shows an isometric exploded view of the LED module 34, which fits into the straight heat sink housing 150 to form the straight LED heat sink assembly 152. As described previously, the LED module 34 includes an LED 18, an LED housing 20, a lens 22, and a cap 30, which attaches to the LED housing 20 by screw threads 32. As shown in especially in FIGS. 13 and 14, the rear portion 40 of the straight LED housing 150 is not angled. The front portion 38 includes a recess 36 which is configured to receive the LED module 34.

As before, the heat sink housing 150 is configured with a central bore 60, inner tube 62, outer tube 66, internal fins 82, and thus is also configured as a finned concentric tube 88, and includes external fins 74 with the before-described parameters of thickness, height and spacing. Each of these parameters have been carefully analyzed and designed to be within a specified range to increase cooling. In addition, the straight heat sink housing 150 includes side vents 160 for special design air flow past the LED module for better cooling. It is of course possible that the angled housing 50 include this feature as well. The side vents 160 preferably connect with a cooling cavity 39 which has been configured between the back of the LED module and the internal channels 83. This allows for increased air circulation and increased cooling performance.

A straight LED cooling system 154 has the advantage that multiple units of this system can be grouped together with their cooling pipes 114 connected to a common duct or vent, (not shown) allowing LEDs to be concentrated together for brighter lighting effects.

Generally, the LED cooling system 10 of the present invention is very adaptable to a variety of applications. The LED housing 20 will fit multiple LED types, and can used with single or multiple LEDs. The LED module 34 can hold a variety of different lenses i.e.: clear, prismatic, frosted, linear, etc. It is possible to use an extended cover with varying focal properties to change light beam spreads. An additional focal optic can be added to allow the different focal beam spreads. This will allow the LED system 10 to be place at a higher level in the building or outside application such as parking and street lighting. Different lens options can be added to enhance the light output or change the direction of the light output such as diffusion or linear spread of light in a line. Different color temperature LEDs 18 can change the color output of the light. Color changing LED's with red, green, blue and white LEDs can be used.

The cooling pipe 114 can be extended any virtually any desired length, and as described above, they can be used to funnel heat to a common heat release chamber or duct. The cooling pipes 114 may also be jointed or have swivel mounts included so that the light may be directed as desired and can be used to adapt to many different ceiling heights, and wall configurations. Several heat sink assemblies 12 or systems 10 can be grouped to multiply light output, they can utilize a single common power supply, while they can be each controlled individually, remotely and wirelessly.

The LEDs 18 in the system can be dimmed in an almost continuous manner, in digital steps of 0 to 255 levels or more if needed, unlike fluorescent lights, which require certain threshold voltages to remain illuminated.

The LED cooling system 10 can be mounted alone on a canopy, on a pendent down rod, or on a track. The LED heat sink assemblies 12 can be different sizes, although the basic ratio of diameters to other parameters is preferred, and they can be fabricated in any color, and can be made of different materials such as aluminum, copper, brass, etc. The LED module 34 itself can have different shapes and sizes of shapes, and the present heat sinks 50, 150 can be configured to receive them.

While various embodiments have been described above, it should be understood that they have been presented by way of example only, and not limitation.

INDUSTRIAL APPLICABILITY

The present LED heat sink 20 and LED cooling system 10 is well suited generally for lighting applications, both indoor and outdoor.

LEDs are solid state devices and if operated at low currents and at low temperatures, are subject to very limited wear and tear. Typical lifetimes are estimated to be 35,000 to 50,000 hours of useful life, compared to 10,000 to 15,000 hours for fluorescent tubes, and 1,000-2,000 hours for incandescent light bulbs. LEDs are also less fragile than fluorescent and incandescent bulbs, and are less susceptible to damage by external shock. LEDs produce more light per watt than incandescent bulbs, and have been found to have significant environmental benefits compared to other alternatives. It has been estimated that a building's carbon footprint from lighting can be reduced by 68% by exchanging all incandescent bulbs for new LEDs.

However, efficiencies and lifetimes of LEDs are dependent on adequate cooling. Thus it is very important that low temperatures are maintained, and for this reason an improvement in heat sinks for LEDs is a very important development.

The present LED cooling system 10 provides several improvements and variations in these improvements over standard LED systems. The present heat sink housing 16, which can be either an angled heat sink housing 50 or a straight heat sink housing 150, both include a finned concentric tube 88 configuration. This includes an inner tube 62 and an outer tube 66 which have internal fins 82 connecting the two tubes 62, 66. External fins 74 are also preferably included, and these elements have been carefully analyzed and designed with regard to multiple parameters to give very efficient air flow and heat transfer away from the LED module 34.

The LED cooling system 10 is provided in several varieties for use with the angled heat sink 50 and the straight heat sink 150.

The angled heat sink LED cooling system 54 preferably includes a frame 14, which preferably includes a baseplate 90 and two lips 92. The lips 92 serve to elevate the baseplate 90 from any surface it is mounted on, and create an air channel 93, which allows air flow to pass to and from the heat sink housing 50. Two varieties of frame 14 include a planar frame 94, and a corner frame 96. In either frame variation 94, 96, the baseplate 90 includes an air-channel cut-out 95, so that an air passage is created which extends down the air channel 93, through the cut-out 95, and extends down the inner tube 66 and the outer tube 66 to reach and cool the LED module 34.

A second preferred embodiment of the LED cooling system 10 includes a straight heat sink housing 150, in a straight LED cooling system 154, which preferably includes a cooling pipe 114 to provide an air cooling channel 93 for cooling the LED module 34. The frame 14, of both the planar frame 94 and corner frame 96 varieties, and the cooling pipe 114 used in the straight LED cooling system 154, provide an air cooling channel 93 and can be considered to be air cooling channel devices 99. A cooling cavity 85 is preferably formed between the back of the LED module 34 and the interior channels 83 into which air traveling down the air cooling channel 93 and into the inner tube 66 and internal channels 83 can circulate and more effectively remove heat from the LED 18.

Many variations in the LED cooling systems 10, 54, 154 are possible, and are very adaptable to a variety of applications. The LED housing 20 will fit multiple LED types, and can used with single or multiple LEDs 18. The LED module 34 can hold a variety of different lenses i.e.: clear, prismatic, frosted, linear, etc. It is possible to use an extended cover with varying focal properties to change light beam spreads. An additional focal optic can be added to allow the different focal beam spreads. This will allow the LED system 10 to be place at a higher level in the building or outside application such as parking and street lighting. Different lens options can be added to enhance the light output or change the direction of the light output such as diffusion or linear spread of light in a line. Different color temperature LEDs can change the color output of the light. Color changing LED's with red, green, blue and white LED's can be used. The LEDs 18 in the system 10 can be dimmed in an almost continuous manner, in digital steps of 0 to 255 levels or more if needed, unlike fluorescent lights, which require certain threshold voltages to remain illuminated.

A straight LED cooling system 154 has the advantage that multiple units of this system can be grouped together with their cooling pipes 114 connected to a common duct or vent, thus allowing LEDs to be concentrated together for brighter lighting effects. The cooling pipe 114 can be extended any virtually any desired length, and as described above, they can be used to funnel heat to a common heat release chamber or duct. Several LED heat sink assemblies 12 or systems 10 can be grouped to multiply light output, and they can utilize a single common power supply, while they can be each controlled individually, remotely and wirelessly.

The heat sink LED cooling system 10 can be mounted alone on a canopy, on a pendent down rod, or on a track. The LED heat sink assemblies 12 can be different sizes, although the basic ratio of diameters to other parameters is preferred, and they can be fabricated in any color, and can be made of different materials such as aluminum, copper, brass, etc. The LED module 34 itself can have different shapes and sizes of shapes, and the present heat sinks housings 16 can be configured to receive them.

In short, almost anywhere that standard lighting is used, LEDs with the present LED cooling system can be used. The savings in energy use and the reduction in the carbon footprint created can have huge environmental and social benefits.

For the above, and other, reasons, it is expected that the heat sinks 16 and LED cooling system 10 of the present invention will have widespread industrial applicability. Therefore, it is expected that the commercial utility of the present invention will be extensive and long lasting.

What is claimed is:

1. A heat sink for cooling LEDs, comprising:

a heat sink housing which is configured as a finned concentric tube configuration wherein said finned concentric tube configuration includes an outer tube with a central bore and an inner tube which are connected by internal fins to create internal channels, and further comprising a cooling cavity within said heat sink housing, which cools said LED by air convection; and further comprising a plurality of side vents configured into said outer tube, and connecting to said cooling cavity such that air is drawn into said cooling cavity, removing heat from said LED, and the air then passes through said internal channels to vent to the ambient surroundings and thus cool said LED.

2. The heat sink of claim 1, wherein said heat sink housing includes external fins.

3. The heat sink of claim 2, wherein said external fins each have a fin spacing and a fin height and said external fins are configured with a ratio of fin spacing to fin height in the range of 0.5:1.0 to 2.0:1.0.

4. The heat sink of claim 1, wherein said central bore has a cross-sectional area, and each of said internal channels has a cross-sectional area wherein the ratio of said central bore cross-sectional area to internal channel cross-sectional area is in the range of 1:1 to 3:1.

5. The heat sink of claim 1, wherein said heat sink housing is an angled heat sink housing.

6. The heat sink of claim 5, wherein said angled heat sink housing is angled in a range of 5 to 120 degrees.

7. The heat sink of claim 1, wherein said heat sink housing is a straight heat sink housing.

8. The heat sink of claim 7, wherein said straight heat sink housing includes side vents.

9. An LED heat sink assembly, comprising:

a heat sink housing which is configured as a finned concentric tube configuration wherein said finned concentric tube configuration includes an outer tube with a central bore and an inner tube which are connected by internal fins to create internal channels and having a recess for receiving an LED module; and an LED module which is fitted into said recess, wherein said finned concentric tube configuration further comprises a cooling cavity within said heat sink housing, which cools said LED module by direct air convection contact with said LED module, wherein said cooling cavity is configured between the back side of said LED module and said internal channels such that internal channels act by venturi action to draw air past said LED and thus cool said LED by convection cooling.

10. The LED heat sink assembly of claim 9, wherein said heat sink housing includes external fins.

11. The heat sink assembly of claim 9, wherein said heat sink housing is an angled heat sink housing.

12. The heat sink assembly of claim 9, wherein said heat sink housing is a straight heat sink housing.

13. An LED cooling system, comprising:

an LED heat sink assembly which includes a heat sink housing configured as a finned concentric tube configuration wherein said finned concentric tube configuration includes an outer tube with a central bore and an inner tube which are connected by internal fins to create internal channels, wherein said finned concentric tube configuration further comprises a cooling cavity within said heat sink housing;

a plurality of side vents configured into said outer tube, and connecting to said cooling cavity such that air is drawn into said cooling cavity, removing heat from said LED, and the heated air then passes through said internal channels to vent and thus cool said LED; and an air cooling channel device.

14. The LED cooling system of claim 13, wherein said air channel includes a frame.

15. The LED cooling system of claim 13, wherein said air channel includes a cooling pipe.

16. The LED cooling system of claim 14, wherein said frame is a planar frame.

17. The LED cooling system of claim 14, wherein said frame is a corner frame.

18. The LED cooling system of claim 13, wherein said heat sink housing is an angled heat sink housing.

19. The LED cooling system of claim 13, wherein said heat sink housing is a straight heat sink housing.

20. A method of cooling LED modules, comprising:

a) providing an LED module;

b) providing an LED cooling system having a heat sink housing which is configured as a finned concentric tube configuration wherein said finned concentric tube configuration includes an outer tube with a central bore and an inner tube which are connected by internal fins to create internal channels, wherein said finned concentric tube configuration further comprises a cooling cavity within said heat sink housing, and a plurality of side vents configured into said outer tube, and connecting to said cooling cavity such that air is drawn into said cooling cavity, removing heat from said LED, and the heated air then passes through said internal channels to vent and thus cool said LED; and having a recess for receiving said LED module; and c) fitting said LED module into said recess of said heat sink housing to remove heat from the LED through the heat sink.

21. The method of cooling of claim 20, wherein said heat sink housing includes external fins.

22. The method of cooling of claim 20, wherein said heat sink housing is an angled heat sink housing.

23. The method of cooling of claim 20, wherein said heat sink housing is a straight heat sink housing.

24. The method of cooling of claim 20, wherein said led cooling system includes an air cooling channel device.

* * * * *